US006881007B2

(12) United States Patent
Dennis

(10) Patent No.: US 6,881,007 B2
(45) Date of Patent: Apr. 19, 2005

(54) APPARATUS AND METHOD TO SECURE MANHOLE ACCESSWAYS

(75) Inventor: Gordon K. Dennis, Lansdale, PA (US)

(73) Assignee: H&M - AMH, Inc., Wilmington, DE (US)

( * ) Notice: Subject to any disclaimer, the term of this patent is extended or adjusted under 35 U.S.C. 154(b) by 0 days.

(21) Appl. No.: 10/376,967

(22) Filed: Feb. 28, 2003

(65) Prior Publication Data

US 2004/0170474 A1 Sep. 2, 2004

(51) Int. Cl.[7] ..... E02D 29/14
(52) U.S. Cl. ..... 404/25; 52/20
(58) Field of Search ..... 404/25, 26; 52/19, 52/20

(56) References Cited

U.S. PATENT DOCUMENTS

| | | | | | |
|---|---|---|---|---|---|
| 822,562 | A | * | 6/1906 | Tucker | 292/37 |
| 845,182 | A | * | 2/1907 | Letts | 70/168 |
| 2,363,567 | A | * | 11/1944 | Blakeman | 292/6 |
| 4,175,781 | A | | 11/1979 | Dumortier | 292/218 |
| 4,964,755 | A | * | 10/1990 | Lewis et al. | 404/25 |
| 5,328,291 | A | | 7/1994 | Wisniewski | 404/2 |
| 5,540,411 | A | * | 7/1996 | Strickland | 249/145 |
| 5,611,640 | A | * | 3/1997 | Bowman | 404/4 |
| 5,697,729 | A | * | 12/1997 | Bowman | 404/25 |
| 5,727,351 | A | | 3/1998 | Neathery et al. | 52/20 |
| 5,827,007 | A | | 10/1998 | Barton et al. | 404/25 |
| 5,951,200 | A | | 9/1999 | Barton | 404/25 |
| 6,435,763 | B1 | | 8/2002 | Sakane et al. | 404/25 |
| 6,550,294 | B1 | * | 4/2003 | Garguilo | 70/168 |

* cited by examiner

*Primary Examiner*—Thomas B. Will
*Assistant Examiner*—Alexandra K. Pechhold
(74) *Attorney, Agent, or Firm*—Stradley Ronon Stevens & Young, LLP

(57) ABSTRACT

A manhole access way security apparatus and method for using the security apparatus are disclosed. The inventive security apparatus includes an insert, at least one locking pin and a locking mechanism each interconnected to allow users to easily and quickly install a security barrier under a manhole, handhole or vault, and thereby prevent authorized access through the manhole, handhole or vault. The inventive apparatus uses an insert that may either sit on the existing manhole frame rim under the manhole cover, or if there is insufficient clearance on the manhole frame rim, brackets may be installed under the manhole frame upon which the insert rests. In either configuration, the insert is secured in place under the manhole cover by one or more locking pins that extend radially through the insert and are then locked to the insert. The limited elements of the inventive security apparatus provides users with an easy method of increasing security of underground infrastructure without the need for extensive modification or alteration of existing manhole structures.

7 Claims, 3 Drawing Sheets

APPARATUS AND METHOD TO SECURE MANHOLE ACCESSWAYS

This invention generally relates to mechanisms for preventing unauthorized access into manhole access ways. More particularly, the present invention is directed to an inventive apparatus and method to prevent unauthorized entry into underground infrastructure areas attained through manhole access ways. The inventive method for securing and opening the manhole security apparatus is straightforward and uncomplicated, and allows each user to employ their own locking mechanism. The apparatus to secure the access way has a limited number of elements that may be used with conventional manhole cover access ways after minimal retrofitting of the installed manhole access way.

One embodiment of the inventive manhole cover security system includes an insert that is sized and configured to fit within and on the existing frame of a manhole, one or more locking pins that extend through the insert, and a locking mechanism that secures each of the locking pins to the insert. In another embodiment of the security system, the insert is sized and configured to fit within the existing manhole cover frame, and on brackets or a rim that is installed below the manhole cover frame. As in the first embodiment, the latter security system embodiment also includes one or more locking pins that extend through the insert, and a locking mechanism to secure each of the locking pins to the insert.

The manhole access way security method and apparatus disclosed provides an additional means of preventing unauthorized access through a manhole and provides a further tool for protecting the public infrastructure.

BACKGROUND DESCRIPTION

The security and maintenance of the public's infrastructure has always been important. However, with recent world-wide events, and the centralization of certain aspects of primary infrastructure elements, including telecommunications systems, equipment and cabling, power transmission and distribution equipment, gas and product lines, and water mains and various associated utility equipment and apparatus, in underground access ways, the security of these underground passages is becoming an increasingly critical issue. For example, with the recent passage of the amendments to the Safe Drinking Water Act, water utilities are now required to be cognizant of and address the issue of manhole access security.

A device to secure access through a manhole must, by design, be easy to use and remove because the purpose of a manhole is to permit access to certain infrastructure, typically underground infrastructure. If a security device does not allow for relatively quick and easy access through the manhole, the security device will not be readily accepted or implemented.

Similarly, because manhole access ways have been installed and used for many years, a security device for use with such in-place manhole structures must be compatible with current standard manhole structures without the need for substantial alteration or retrofitting to the installed structure. If a proposed security device requires extensive redesign or modification of the in-place manhole frame, again, the security device will not be accepted or implemented.

Prior designs for locking mechanisms and security apparatus have been conceived and patented, but none appear to have been widely accepted within the industry. One such invention disclosed in U.S. Pat. No. 6,435,763 issued to Sakane et al., for a "Key Hole Insertion For Manhole And Manhole Cover Locking Apparatus Equipped With The Key Hole Insertion And Manhole Cover Locking System And Unlocking Method And Manhole Cover Opening And Closing Control System," uses a specialized key hole insertion into a key hole in a manhole cover. The disclosed invention appears to use pins that engage into openings within the keyhole. The device disclosed appears to require a completely new type of manhole cover and manhole structure for the locking system.

As noted, if a security system can not be used with existing manhole frame structures, then to use such a security system may entail installation of a new manhole frame structure often with the requirement of time consuming and expensive excavation to remove the old structure and install a new frame structure. If, as understood, the Sakane et al. device requires a new manhole frame, such a device does not appear to be easily implementable or compatible with currently installed manhole structures.

U.S. Pat. No. 5,951,200 issued to Barton for a "Enclosement To Shield Structure Which Secures Entrance-Deterring Cap To Manhole Opening From Water And Dirt Containments", and U.S. Pat. No. 5,827,007 issued to Bartone et al. for a "Entrance-Deterring Cap For Manhole Openings" teaches a manhole protection device including a top pan that rests on a manhole frame rim and a lower elongated bar with end plates that fit under the manhole frame rim. The top pan is secured to the lower elongated bar by a threaded stud to form a seal over the manhole.

Similarly, U.S. Pat. No. 5,727,351 issued to Neathery et al. for a "Manhole Insert And Tether And Method" discloses a watertight manhole insert to prevent rainwater from entering a sanitary sewer or other system. A lever bar locking device is also described to crimp the tether after it is pulled through the insert.

Another example of a locking cover taught by U.S. Pat. No. 5,328,291 issued to Wisniewski for a "Locking Manhole Insert" also includes a manhole insert with a disc having a plurality of locking radial arms under the insert. The disc may be padlocked in place after the radial arms are extended through guides at the edge of the insert. While each of the Bartone, Bartone et al., Neathery et al., and Wisniewski devices provide a locking cover for a manhole, none of these devices appears to present a viable and complete solution to the problem of providing an easily installed security system to current manhole access ways.

Finally, a locking latch for use with a manhole cover is disclosed in U.S. Pat. No. 4,175,781 issued to Dumortier for a "Latching Arrangement For Manhole Cover." The Dumortier locking latch device is only a latching key configured to fit in a manhole cover and does not describe or provide a separate element to prevent access through a manhole if the manhole cover is removed.

Accordingly, there is a need for a security apparatus and method of easily, quickly and effectively securing access through manholes and man-ways and thereby preventing unauthorized entry into underground and above ground infrastructure. Such a system should allow for easy retrofitting of currently installed manhole cover frames, and should allow users to install and use their own locking mechanism. Such a device does not currently exist, but is eagerly sought to improve the security of manhole access ways.

SUMMARY OF THE INVENTION

In view of the shortcomings of the prior art, it is an object of the present invention to provide a security apparatus and method for securing access through manholes and thereby preventing unauthorized entry into underground infrastructure facilities and passageways. It is a further object of the present invention that the security device can be used with current manhole frames without the need for extensive retrofitting of installed manhole frame structure.

To achieve this and other objects, and in view of its purposes, the present invention provides a manhole cover security system for use with a manhole cover and a manhole cover frame, the security system comprising a security insert sized to fit on the manhole cover frame and under the manhole cover, the insert having at least one receiving hole; at least one locking pin, the locking pin fitting through the at least one receiving hole; and at least one locking means, whereby the at least one locking pin may be secured to the security insert by locking the at least one locking pin to the security insert with the locking means.

The security insert may in different preferred embodiments be a solid metal pan, or have a screened section, or may have one or more vent holes to allow for the venting of gases and, in the application for certain utilities or powered equipment, the venting of heat.

Another embodiment of the present invention provides a manhole cover security apparatus for use with a manhole cover and a manhole cover frame, the security system comprising a plurality of brackets positioned under the manhole cover frame; a security insert sized to fit within the manhole cover frame and sit on the plurality of brackets, the insert having at least one receiving hole; at least one locking pin, the locking pin fitting through the at least one receiving hole and under the manhole cover frame; and at least one locking means, whereby the at least one locking pin may be secured to the security insert by locking the at least one locking pin to the security insert with the locking means.

A further aspect of the present invention provides a manhole access security system for use with a manhole cover and a manhole cover frame, the security system comprising a security insert sized to fit on the manhole cover frame and under the manhole cover, the insert having a plurality of receiving holes formed in the security insert, and a plurality of attaching means, with one of each the attaching means located adjacent to each of the plurality of receiving hole; and a plurality of locking pins, the locking pins fitting through the plurality of receiving holes, the plurality of locking pins each having a locking segment, wherein after each of the plurality of locking pins is placed through the plurality of receiving holes, each of the plurality of locking pins can be locked to the security insert by locking each of the plurality of locking pin locking segments to the plurality of attaching means on the security insert.

It is a further object of the present invention to provide a method for restricting access to underground infrastructure through manhole access ways, the method comprising the steps of inserting a security cover under an existing manhole cover, the security cover having a plurality of locking pin receiving holes; drilling through each of the plurality of locking pin receiving holes into material surrounding and under the manhole cover; inserting a locking pin through each of the plurality of locking pin receiving holes; and fastening the security cover in place under the existing manhole cover by locking each of the plurality of locking pins extending through the security cover to the security cover.

A still further object of the present invention is to provide a method for restricting access to above ground infrastructure through man-way access ways, the man-way access ways having a man-way cover and surrounding support structure, the method comprising the steps of inserting a security cover under the existing man-way cover; and fastening the security cover in place under the existing man-way cover by locking a plurality of locking pins to the security cover, the plurality of locking pins extending radially through the security cover into the support structure surrounding the man-way cover.

These and other aspects of the present invention are set forth below with reference to the drawings and the detailed description of certain preferred embodiments. It is to be understood that both the foregoing general description and the following detailed description are exemplary, and are not intended to be or should be considered restrictive of the invention.

BRIEF DESCRIPTION OF THE DRAWINGS

The invention is best understood from the following detailed description when read in connection with the accompanying drawings. It is emphasized that, according to common practice, the various features of the drawing are not to scale. On the contrary, the dimensions of the various features are arbitrarily expanded or reduced for clarity. Included in the drawings are the following Figures.

DETAILED DESCRIPTION OF PREFERRED EMBODIMENTS

The present invention is directed to a manhole security apparatus designed to allow for the easy installation of a reliable and strong device to prevent unauthorized access to manholes and man-ways and the infrastructure within the manhole. The present invention also is directed to a method for installing and using the inventive manhole security apparatus.

The inventive security apparatus has three primary elements, including an insert that is placed under the conventional manhole cover, at least one locking pin that fits through the insert and extends radially outside of the installed manhole frame structure, and a locking mechanism for securing each of the locking pins to the insert. All of these elements are located underneath a conventional manhole cover and thus no alteration to the manhole cover is necessary. Moreover, as installed and in place under the manhole cover, the inventive security apparatus is not readily visible or noticeable to the public.

Figure 1:
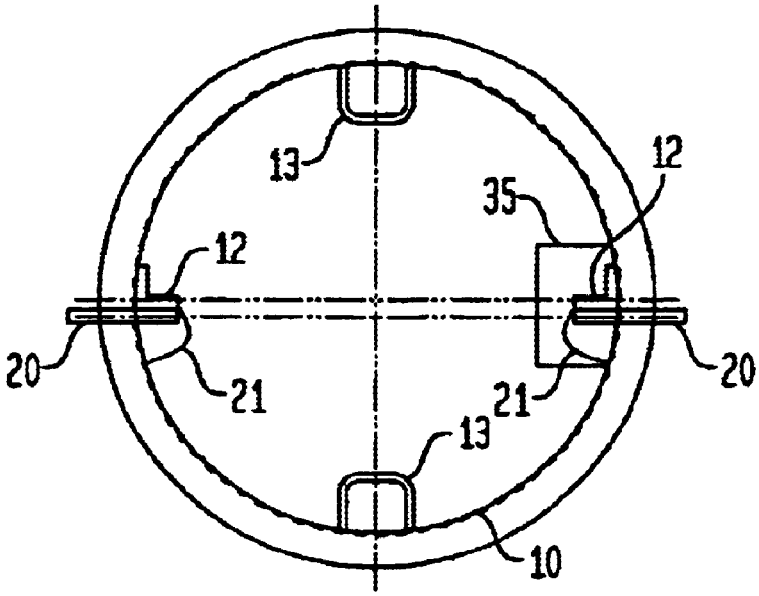
FIG. 1 is an overhead view of an illustration of the present inventive manhole security apparatus with two locking pins, and with the insert configured to sit on an existing manhole frame rim.
Figure 2:
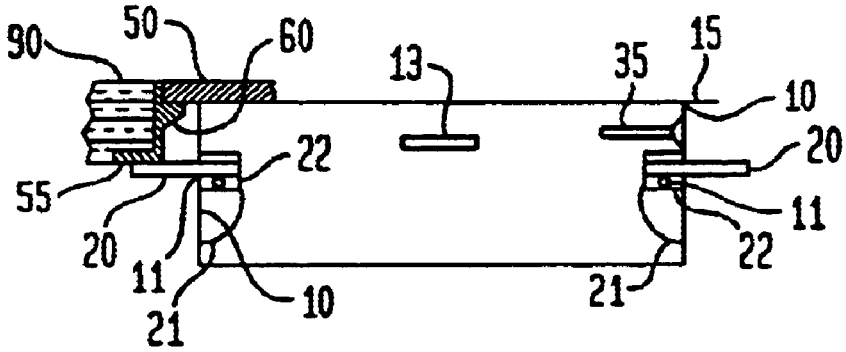
FIG. 2 is a side view of an illustration of the present inventive manhole security apparatus with two locking pins, and with the insert configured to sit on an existing manhole frame rim under the manhole cover.
Figure 3:
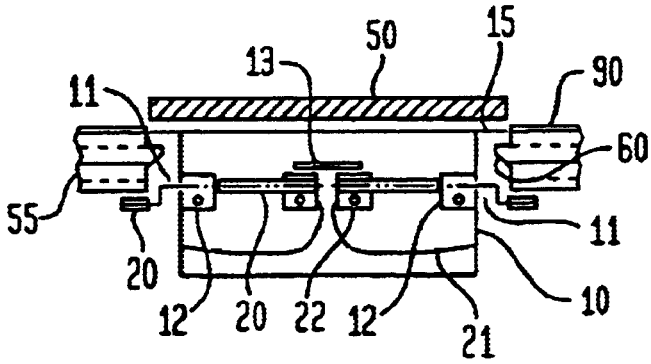
FIG. 3 is an exploded side view of an illustration of the present inventive manhole security apparatus with two locking pins, and with the insert configured to sit on an existing manhole frame rim under the manhole cover.

In one preferred embodiment of the inventive security apparatus, as shown in FIGS. 1, 2 and 3, an insert 10 is sized and configured to sit on the in-place manhole frame 55. A manhole frame typically has a rim 60, as shown in FIGS. 2 and 3, upon which the manhole cover 50 normally rests. In the embodiment shown in FIGS. 1, 2, and 3, the insert 10 is installed on the manhole frame rim 60, and the manhole cover 50 is then placed over the insert.

To secure the insert 10 in place under the manhole cover 50, one or more locking pins 20 extend through receiving holes 11 formed in insert 10. As shown in FIG. 2, the locking pins 20 extend radially, or away from the center of the insert 10, beyond the edge of the insert 10 and are positioned below the bottom of the installed manhole frame 55. After the locking pins 20 are placed through the receiving holes 11 and into the surrounding support material, each locking pin 20 is then locked to the insert 11 by a conventional locking means. Such a conventional locking means includes, without limitation, a padlock, a key-type lock, a combination lock, and/or a cable-type lock.

In one preferred embodiment, as illustrated in FIGS. 1, 2 and 3, two locking pins 20 are used and place diametrically opposite to each other through the receiving holes 11 in the insert 10. To assist with securing of the locking pins 20 to the insert 10, each locking pin 20 has a plate 22 at its end. The locking pin plate 22 has a hole sized to accept a padlock ring. The locking pins 20 are secured to the insert 10 through use of insert brackets 12 that are attached to the insert 10. Each bracket 12 has a respective hole in it to also accept a padlock ring. Once in place, the locking pin plate 22 hole is aligned with the insert bracket 12 hole, and by a conventional padlock 30, the locking pins 20 are secured to the insert 10. The insert brackets 12 may be separate elements or pieces that are securely attached to the insert 12 by, for example, welding, or the insert brackets 12 may be formed as part of the insert 12 during fabrication of the insert 12.

With the insert in the locked or secured configuration, the locking pins are positioned below the manhole frame, and thus the insert 10 cannot be removed. As such, with the insert 10 locked in place by the locking pins 20, access to the manhole is restricted to only those personnel with clearance or authority to remove the locks 30 and locking pins 20.

For the embodiment shown in FIG. 2, each locking pin 20 is located immediately below the manhole frame 50. In other preferred embodiments, the locking pins 20 and respective receiving holes 11 in the insert 10, may be positioned further below the manhole frame 55 and thus could be embedded in the material surrounding the manhole frame. That material could be concrete or another solid support medium such as brick masonry.

While the illustrations shown in FIGS. 1, 2, and 3, disclose using two locking pins 20, the use of more or less locking pins 20 may be equally acceptable. For example, one locking pin 20 may be satisfactory for certain lower security applications. In other high security applications, users may find the one locking pin embodiment as being less secure as compared to using two or more locking pins 20.

The use of more than two locking pins provides a certain level of increased security. For example, three locking pins located at equal angles of 120° around the circumference of the insert 10 provides added security over using two pins. Similarly, using four locking pins 20 at equal angles of 90° provides still further protection. However, the increase in protection or security comes at the price of additional material, including the locking pins 20, and locks 30. The added protection also comes at a cost of increased time to install the locking pins 20 into the support material under the manhole frame, and with increased time to remove the security device and to obtain access to the manhole or man-way.

Figure 4:
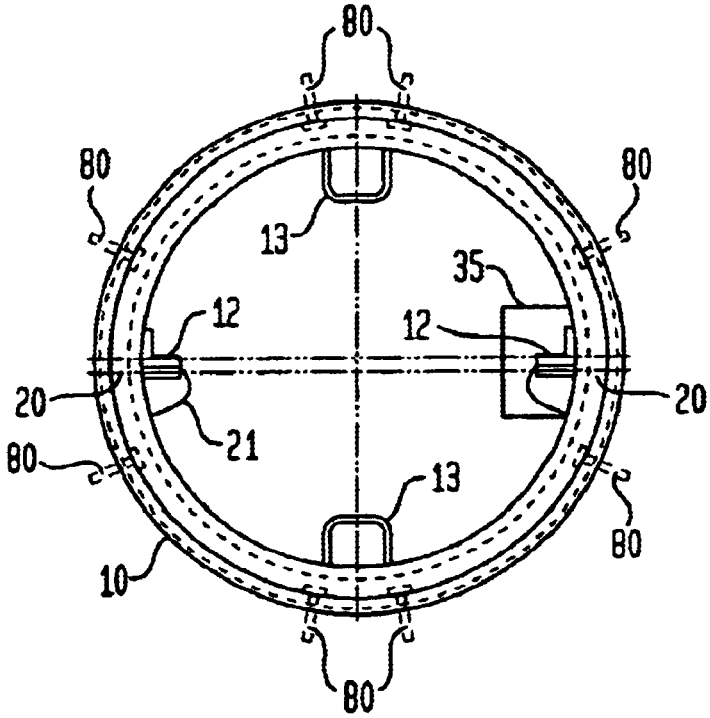
FIG. 4 is an overhead view of an illustration of the present inventive manhole security apparatus with two locking pins, and with the insert configured to sit on a plurality of brackets installed under the existing manhole frame rim.

To assist with the installation, use and removal of the security apparatus, handles 13 may be installed on the insert 10 as shown in FIGS. 1 and 4. After removing the locking pins from the insert receiving holes 11, the user can easily grasp one or more handles 13, and lift the insert 10 out of the manhole frame. Moreover, to ensure that the locking pins 20 are not lost once removed from the insert hole 11, a chain or restraining line 21 can be used. More specifically, one end of the restraining line 21 would be attached to the locking pin 20 and the other end of the restraining line would be attached to the side of the insert 10 as shown in FIGS. 2, 3, 5 and 6. With the restraining line, the possibility of the locking pins falling into the manhole or being otherwise misplaced is substantially prevented.

An exploded view of a preferred example of the inventive security apparatus is shown in FIG. 3. As illustrated, the insert 10 may be shaped as an inverted hat with a rim 15 that is sized to sit on the manhole frame rim 60. Where the insert 12 is fabricated from metal, such as stainless steel, the insert may, in a preferred embodiment, have a thickness of approximately 0.10 to 0.25 inches. The manhole cover 50 then is placed over the insert 10. In many applications, the manhole frame rim 60 has a depth below the surface 90 surrounding the manhole frame 55 that with the insert 10 and manhole cover 50 in place, the top surface of the manhole cover is substantially the same level as or flush with the surrounding surface 90. This is illustrated on the left-hand section of FIG. 2.

However, there may be applications in which the surrounding surface 90 is not build up substantially, or where the top surface of the manhole cover 50 need be particularly even with the surrounding surface. In such applications, with the insert 10 being positioned on the manhole frame rim 60, the manhole cover 50 may be raised above the surrounding surface 90. For this situation, another preferred embodiment of the inventive security apparatus provides a solution.

Figure 5:
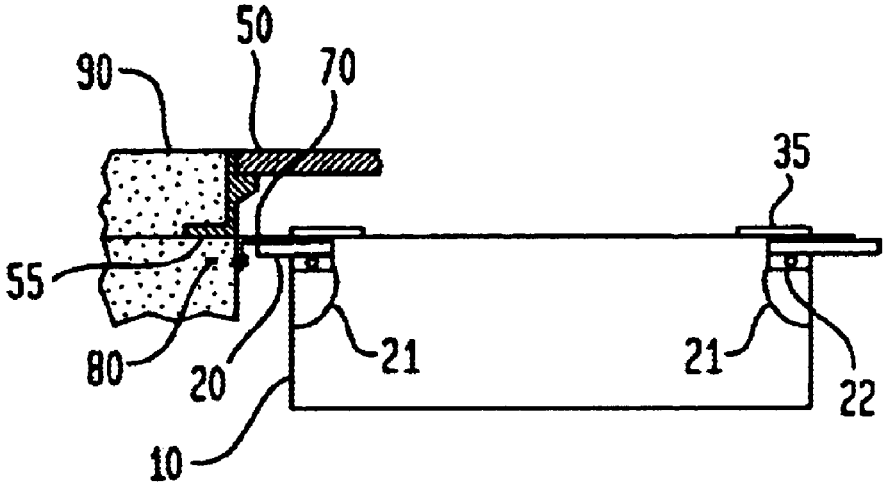
FIG. 5 is a side overhead view of an illustration of the present inventive manhole security apparatus with two locking pins, and with the insert configured to sit on a plurality of brackets installed under the existing manhole frame rim.
Figure 6:
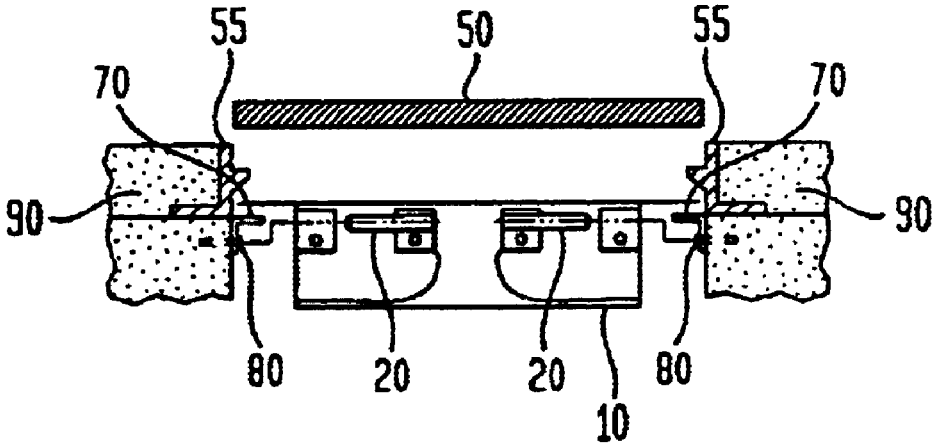
FIG. 6 is an exploded side overhead view of an illustration of the present inventive manhole security apparatus with two locking pins, and with the insert configured to sit on a plurality of brackets installed under the existing manhole frame rim.

As shown and illustrated in FIGS. 4, 5, and 6, in this embodiment, the insert 10 is sized and configured to fit through the manhole frame 55. Instead of sitting on the manhole frame rim 60, the insert 10 is placed on a plurality of brackets 70 that are located below the manhole frame 55. The brackets 70 are rigidly anchored into the support material under the manhole frame 55. As noted, in a typical application, the support material around a manhole for underground access ways is concrete or other masonry block. The brackets 70 may be anchored into the concrete or masonry support by bolts 80 or other similar attachments. To ensure sufficient support for the insert 10, multiple brackets 70 and bolts 80 should be installed. FIG. 4 shows eight brackets 70 and bolts 80 located along the circumference of the manhole, although more or less brackets 70 and anchors may be used, so long as the set of brackets provides a solid platform for the insert 10. With this preferred embodiment, the manhole cover 50 sits on the manhole frame rim 60 in the same configuration and elevation as if no security apparatus were installed.

In another preferred embodiment, instead of multiple smaller brackets anchored to the supporting surface wall, as illustrated in FIGS. 5 and 6, a larger or longer rim bracket may be used. The use of longer rim brackets would have particular application for manhole cover frames that are square or rectangular in shape.

Although the insert 10 shown in the illustrations is a solid configuration, in other preferred embodiments, the insert could be fabricated with one or more vent holes or drain holes. With the use of vent holes, air or gas is permitted to flow into or out of the security apparatus. Similarly, in other applications, it may be important to not allow water or other fluids to accumulate under the manhole cover 50 and on top of the insert 10. With multiple vent or drain holes formed in the insert 10, the unintended collecting of water is prevented.

In still another embodiment, the insert 10 can be manufactured with screening or a window in one section to permit either observation into the manhole or venting of heat from within the manhole. The screening or window should be sized small enough to permit observation into the manhole, but not permit access into the manhole.

To further ensure that the manhole access is secured and that unauthorized entry is not obtained through tampering with the locking device 30 or locking pins 20, in another preferred embodiment, a plate or cover 35 can be fabricated on the insert 10 just above each insert bracket 12 and receiving hole 11. As shown in FIGS. 2 and 5, a cover 35 is place above each of the insert receiving holes 11, and respective insert brackets 12. The use of the cover 35 would substantially prevent someone from using wire cutters or bolt cutters to remove the lock. Similar to the above disclosed brackets 12, the covers 35 may be separate sections that are permanently attached to the insert 10, such as by welding. Alternatively, the covers 35 may be fabricated as part of the insert 10 during the manufacturing of the insert 10.

As an additional level of security for the manhole security apparatus, wired electronic, fiber optic, or wireless monitoring of the locking pins 20, or the insert 10 may be implemented. Such electronic or fiber optic monitoring can be connected to a local alarm in or close to the manhole, or it may be transmitted to a central security location.

While different materials may be used from which to fabricate the insert 10 and locking pins 20, in one preferred embodiment, hardened stainless steel provides substantial strength and security for the device elements. Stainless steel protects the device elements from corrosion and rust which is always a concern with devices exposed to the outside environment. In one preferred embodiment, providing a high level of security, the locking pins are fabricated from stainless steel having a diameter of ¾ inch and a length of 6 inches. In addition to stainless steel or other metals, the insert may be fabricated from various composite materials, including, without limitation, Kevlar®, carbon-glass composites, or carbon-carbon composites. One primary property of the insert 10, regardless of the type of material it is fabricated from, is that the insert not be easily broken or breached.

The present invention further provides a method to restrict access to underground or above ground infrastructure through manhole access ways. The method includes use of the above disclosed security apparatus and comprises a first step of inserting the security cover 12 under an existing manhole cover 50. Next, the security cover 12 is fastened in place under the existing manhole cover 50 by locking a plurality of locking pins 20 to the security cover 12. As shown in FIG. 1, the plurality of locking pins 12 each extend radially through the security cover 12 into the material that surrounds and supports the manhole cover frame 55.

Although the invention has been described with reference to exemplary embodiments, it is not limited thereto. For example, while disclosure and illustration of the inventive security apparatus has been made showing two locking pins, as noted the security apparatus is equally effective using three or more locking pins. Further, while the illustrations of certain embodiments of the security apparatus show a circular manhole structure, the inventive security apparatus is not limited to circular configurations, and the insert 10 may be configured for square, rectangular or other manhole or man-way opening shapes. Still further, while the disclosure provided above has focussed on underground manhole access ways, the inventive security apparatus has equal application and utility for above ground man-way access covers. Accordingly, it is intended to be and should be understood that the following claims are to be construed to include other variants and embodiments of the invention which may be made by those skilled in the art as being within the true spirit and scope of the present invention.

What is claimed is:

1. A manhole cover security system for use with a manhole cover and a manhole cover frame, said security system comprising:

a security insert sized to fit on the manhole cover frame and under the manhole cover, said insert having at least one first receiving hole in a side of the security insert;

at least one second receiving hole in the manhole cover frame, where by the at least one first receiving hole in the security insert may be aligned with the at least one second receiving hole in the manhole cover frame;

at least one locking pin, said locking pin fitting through the at least one first receiving hole and through the at least one second receiving hole in the manhole cover frame; and locking means to secure the at least one locking pin to the security insert.

2. The manhole cover security system, according to claim 1, wherein the security insert is a solid structure.

3. The manhole cover security system, according to claim 1, wherein the security insert is a chain-linked structure.

4. The manhole cover security system, according to claim 1, wherein the security insert has a plurality of vent holes.

5. The manhole cover security system, according to claim 1, wherein the locking means is a padlock-type device.

6. The manhole cover security system, according to claim 1, wherein the security insert has two receiving holes, respective two locking pins, and respective two locking means.

7. The manhole cover security system, according to claim 1, wherein the security insert has more than two locking pin receiving holes, more than two respective locking pins, and more than two respective locking means.

* * * * *